US006612233B2

(12) United States Patent
Fujimoto

(10) Patent No.: US 6,612,233 B2
(45) Date of Patent: Sep. 2, 2003

(54) SHEET FEED OFFSET PRESS

(75) Inventor: Shinichi Fujimoto, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 320 days.

(21) Appl. No.: 09/781,396

(22) Filed: Feb. 13, 2001

(65) Prior Publication Data

US 2001/0015145 A1 Aug. 23, 2001

(30) Foreign Application Priority Data

Feb. 18, 2000 (JP) ..... 2000-041023
Nov. 30, 2000 (JP) ..... 2000-364974

(51) Int. Cl.[7] ..... B41F 13/24

(52) U.S. Cl. ..... 101/137; 101/352.01; 101/352.05; 101/137; 101/211; 101/492

(58) Field of Search ..... 101/247, 137, 101/139, 140, 143, 144, 145, 483, 492, 218, 228, 351.1, 352.01, 352.02, 352.03, 352.04, 352.05, 211, 148

(56) References Cited

U.S. PATENT DOCUMENTS 4,000,692 A * 1/1977 Wirz et al. ..... 101/144
4,742,772 A * 5/1988 Grose ..... 101/228
4,798,138 A 1/1989 Brodie ..... 101/365
5,029,526 A 7/1991 Kipphan et al. ..... 101/350
5,081,926 A * 1/1992 Rodi ..... 501/137
5,174,210 A * 12/1992 Rodi et al. ..... 101/492
5,218,903 A * 6/1993 MacConnell et al. ..... 101/148
5,249,523 A 10/1993 Kanzler et al.
5,388,514 A * 2/1995 Eltner ..... 101/483
5,447,102 A * 9/1995 Pfeiffer et al. ..... 101/492
6,055,907 A * 5/2000 Endisch et al. ..... 101/352.01

FOREIGN PATENT DOCUMENTS

| | | |
|---|---|---|
| EP | 0545237 | 6/1993 |
| EP | 0924072 | 6/1999 |
| JP | 62-261441 | 11/1987 |
| JP | 64-45641 | 2/1989 |
| JP | 7-102698 | 11/1995 |
| JP | 11-240139 | 9/1999 |

OTHER PUBLICATIONS

Notice of Reasons of Rejection mailed on Jan. 31, 2003 for the corresponding Japenese Patent Application No. 2000–364974.

* cited by examiner

*Primary Examiner*—Eugene H. Eickholt
(74) *Attorney, Agent, or Firm*—Armstrong, Westerman & Hattori, LLP

(57) ABSTRACT

The present invention provides a method for operating a sheet-fed offset press so as to reduce the occurrence of spoilage caused by nonuniform printing. In this method, the timing of start of oscillating motion of oscillating rollers is regulated. Also, the present invention provides an oscillation mechanism for a sheet-fed offset press, in which less failure and wear occur, and a smaller force is required to accomplish a changeover from transmission to stoppage of oscillation and vice versa.

4 Claims, 8 Drawing Sheets

SHEET FEED OFFSET PRESS

FIELD OF THE INVENTION AND RELATED ART STATEMENT

The present invention relates to a method for operating a sheet-fed offset press and, more particularly, to a method for operating a sheet-fed offset press in which an oscillating roller accomplishes an oscillating motion. Also, the present invention relates to an oscillation mechanism for an oscillating roller in an ink supply system for a sheet-fed offset press.

First, a method for operating a sheet-fed offset press, which relates to the present invention, will be described.

To distribute ink on rollers, some number of ink rollers in an offset press have so far been oscillated in the axial direction of the rollers. For a multi-color sheet-fed offset press in which ink rollers are oscillated, sheets supplied from a sheet-feeder are generally printed in one color at each printing station. Each printing station consists of an ink supply system, a dampening system for supplying water, and a number of rollers. Some of these rollers act as oscillating rollers that serve to distribute ink in the roller-width direction.

Many of these oscillating rollers always oscillate by a fixed amount. However, if the oscillating motion of the oscillating rollers continues during the time when printing operation is stopped temporarily for some reason, an ink supply-demand balance between ink transferred to a sheet and ink on the roller, which has been attained during printing operation, is lost undesirably. Specifically, during a steady printing operation, a balance is maintained between the amount of ink supply and the amount of ink transferred to paper sheets such that in printing portions where ink transfers to sheets, the ink supply amount increases, and in non-printing portions where only a small amount of ink transfers to the sheet, the ink supply amount decreases. Therefore, the ink distribution in the axial direction on the rollers is not uniform. However, when the press operation is stopped for some reason, for example, for an error in sheet position setting, if the oscillating rollers continue to be driven, the distribution of ink on the rollers becomes uniform by the distributing effect of the oscillating motion. As a result, when the printing operation is restarted, a number of paper sheets are printed with undesirable nonuniformity until the balanced state maintained before the stoppage of printing operation is achieved again.

In recent years, in some offset presses, the oscillation is started and stopped according to the timing of press operation to decrease such spoilage at the start of printing operation. An example of such a press is in Japanese Patent Laid-open Publication No. 11-240139 (No. 240139/1999). In this press, as the printing operation is started, the oscillation of the oscillating roller having a null or minimum amplitude at first is gradually increased, and the amplitude of the oscillating roller reaches a maximum when a form roller is brought into contact with a plate cylinder. In addition, Japanese Patent Publication No. 7-102698 (No. 102698/1995) discloses a printing press in which the oscillation is started or stopped at the same time that a form roller is separated from or is brought into contact with a plate cylinder.

Next, a conventional oscillation mechanism for an oscillating roller in an ink supply system for a press will be described.

A conventional example of an oscillation mechanism for a form roller, which has been disclosed in the aforementioned Japanese Patent Provisional Publication No. 11-240139 (No. 240139/1999), is explained below with reference to FIG. 9 showing the outline of a general offset press, FIG. 10 showing a oscillation drive system, FIG. 11 showing an essential part of a mechanism for starting and stopping oscillation, and FIG. 12 showing a cross section of FIG. 11.

Referring now to FIG. 9, paper sheets supplied from a sheet-feeder 301 are printed in a printing system 302, and are stacked and discharged to a sheet discharge section 305. The multi-color printing system 302 such as an offset press is composed of a plurality of printing units 302*a*, 302*b*, 302*c* and 302*n* provided according to the number of printing colors, and each printing unit include an ink supply system 303 for supplying ink, which is composed of a plurality of rollers, and a dampening system 304 for supplying dampening water. Of these systems, the ink supply system 303 is provided with a plurality of oscillating rollers 306 that oscillate in the axial direction to slidingly rub form rollers in order to distribute ink uniformly in the width direction.

FIG. 10 is a system diagram of a drive for oscillating the oscillating rollers 306. In this drive system, a driving force is transmitted from a crank of an oscillation drive source 307, which is driven by a drive system 309 for the machine, to an oscillation drive pin 310 provided at the tip end of an oscillation drive lever 311 via a drive link 308. Also as shown in FIG. 12, the oscillation drive lever 311 oscillates around a pin 312 provided on bearers 318 fixed to a machine frame. An oscillating lever 313, which oscillates around the pin 312 in the same way, consists of portions 313*a* and 313*b* for driving the oscillating rollers 306 and a portion 313*c* subjected to an oscillating force by the oscillation drive pin 310.

At the end of the oscillating lever 313*a*, 313*b* is provided an oscillation transmitting portion (details thereof is omitted) 317 for transmitting the oscillating force to the shaft end of the oscillating roller 306. Also, the portion 313*c* is provided with an oscillation drive changeover mechanism 319 that is composed of a change over member 314 engaging with the oscillation drive pin 310 to accomplish a changeover from transmission to stoppage of oscillation and vice versa and a changeover actuator 316 which moves the changeover member 314 to accomplish a changeover from transmission to stoppage of oscillation and vice versa.

As shown in FIG. 11, the changeover member 314 is formed with an arcuate elongated hole 315 such that there is a gap large enough for the oscillation drive pin 310 to slide, and the oscillation drive pin 310 is moved by the drive link 308 so that the range of oscillation produced by the oscillation drive lever 311 is not interfered. Thus, as shown in FIG. 12, the changeover member 314 engages with the oscillation lever 313*c* so as to fit to it and be capable of turning around the oscillation drive pin 310.

The changeover member 314 is moved by the actuator 316 or change over the direction of the elongated hole 315 from A to B and vice versa in FIG. 11, by which the oscillation force is transmitted and stopped. Specifically, when the changeover member 314 is made in the state of A by the actuator 316, the oscillation drive pin 310 oscillated by the oscillation drive lever 311 oscillates only in the elongated hole 315, so that the oscillation force is not transmitted to the oscillation lever 313. On the other hand, when the changeover member 314 is made in the state of B, the oscillation force can be transmitted.

OBJECT AND SUMMARY OF THE INVENTION

In these related arts, the timing of start or stop of oscillation consists of synchronization with the contact of form rollers with the form plate and the start and stop of printing operation. According to a study made by the inventors, it has been found that the timing of start and stop of drive of oscillating rollers described in the related arts is not always optimum. Accordingly, an object of the present invention is to provide a method in which the drive of oscillating rollers is optimized, and spoilage caused by the short-time stoppage of a printing press during operation is minimized.

The present invention provides a method for operating a sheet-fed offset press in which an oscillating roller accomplishes an oscillating motion, comprising: a step of receiving a command to stop printing operation; a step of stopping the oscillating motion of the oscillating roller; and a step of separating a form roller from a form plate after a plate cylinder rotates 2 to 7 turns subsequently.

Also, the present invention provides a method for operating a sheet-fed offset press in which an oscillating roller accomplishes an oscillating motion, comprising: a step of receiving a command to start printing operation; a step of bringing a form roller into contact with a form plate placed on a plate cylinder; and a step of starting the oscillating motion of the oscillating roller after the plate cylinder rotates 2 to 7 turns subsequently.

The method in accordance with the present invention embraces various methods and is not subject to any special restriction if there is provided an oscillating roller such that the oscillating motion thereof can be turned on and off and the amplitude of the oscillating motion can be changed. Also, the drive system of the oscillating roller is not subject to any special restriction. For example, the mechanisms described in the aforementioned Japanese Patent Provisional Publication No. 11-240139 and Japanese Patent Publication No. 7-102698 and preferably a mechanism described below can be utilized to accomplish the oscillating motion of the oscillating roller.

As described above, according to the method in accordance with the present invention, the oscillating motion of the oscillating roller in the sheet-fed offset press can be controlled properly. Therefore, when printing operation is restarted after interruption, a proper ink film thickness profile can be formed rapidly, so that the occurrence of spoilage caused by nonuniform printing can be reduced.

On the other hand, as is apparent from the above description, for the conventional oscillation mechanism for the oscillating roller, the portions for transmitting an oscillating force from the oscillation drive pin 310 to the changeover member 314 are portions indicated by C1 and C2 of FIG. 11, which provides line-to-line contact. Therefore, wear takes place rapidly, and a gap caused by wear produces an impact force when a force is transmitted, which further accelerates wear. Therefore, parts must be replaced early due to wear and breakage.

Also, the changeover actuator 316 requires a large force because a difference between the distance L1 from the turning center of the changeover member 314 to the resistance portion and the distance L2 from the turning center of the changeover member 314 to the point of application for changeover is small. Therefore, the changeover actuator 316 having a high capacity is needed. Therefore, since the size of the changeover actuator 316 is made large, the size of the whole mechanism increases, so that the efficiency of utilization of tight space is decreased.

In view of the above situation, another object of the present invention is to provide an oscillation mechanism for an oscillating roller in which wear of a changeover member for transmitting and stopping an oscillating force is prevented to prolong the life, and the force for changeover is made low to enable a changeover actuator with a low capacity to be used, whereby space saving and low cost are provided, and failure and wear are reduced.

To achieve the above object, the present invention provides an oscillation mechanism for an oscillation roller in an ink supply system for a printing press, comprising an oscillating lever which oscillates around a support point with a predetermined angle to give an oscillating force to an oscillating roller and is formed with oscillation drive bearing portions on both sides on the opposite sides of the support point; first and second energizing members which are in contact with the oscillation drive bearing portions to give a pressing force; and a reciprocating drive means for transmitting a pressing turning force in the normal or reverse direction to the first and second energizing members by reciprocating motion, wherein the transmission of oscillation is stopped by the separation of the first energizing member from the oscillation drive bearing portion.

According to the above-described configuration, the mechanism for transmitting and stopping an oscillating force consists of the pressing of the energizing member to the oscillation drive bearing portion and the separation of the energizing member from the oscillation drive bearing portion, so that there is nothing that is worn. Therefore, wear and breakage caused by the line-to-line contact as in the case of the related arts can be prevented.

Oscillating force transmitting means is characterized in that the first energizing member is pivotally supported by a second support point coaxial with the reciprocating drive means, and the second energizing member is pivotally supported coaxially with the support point of the oscillating lever, whereby the energizing members are turned around the support point of the oscillating lever by an arm connecting the support point of the oscillating lever to the second support point.

According to the above-described configuration, a complicated construction such that the changeover member is fitted on the oscillation drive pin as in the case of the related arts is not needed, and a difference between the distance from the turning center to the resistance portion and the distance to the point of application for changeover can be increased. Therefore, changeover can be effected with a small force, so that an actuator with a low capacity can be used, whereby the mechanism can be configured at a low cost.

Also, another oscillating force transmitting means is characterized in that the energizing members are reciprocatively driven by an arm which pivotally supports the first energizing member at one end, pivotally supports the second energizing member at the other end on the opposite sides of the support point, and further pivotally supports reciprocating drive means at one end. By this configuration, the mechanism can be configured more simply.

Means for separating the first energizing member from the oscillation drive bearing portion is an actuator engaged with the first energizing member. By using such an actuator, the transmission and stoppage of an oscillating force can always be effected.

Also, the transmitting portion for transmitting an oscillating force to the oscillating roller is characterized in that the oscillation drive bearing portion and energizing member are brought into face-to-face contact with each other.

By the face-to-face contact between the oscillation drive bearing portion and the energizing member, wear etc. of the changeover member brought about in the conventional example is eliminated, so that the oscillation mechanism for the oscillating roller that is less failed and worn can be provided.

DETAILED DESCRIPTION OF PREFERRED EMBODIMENTS

Figure 1:
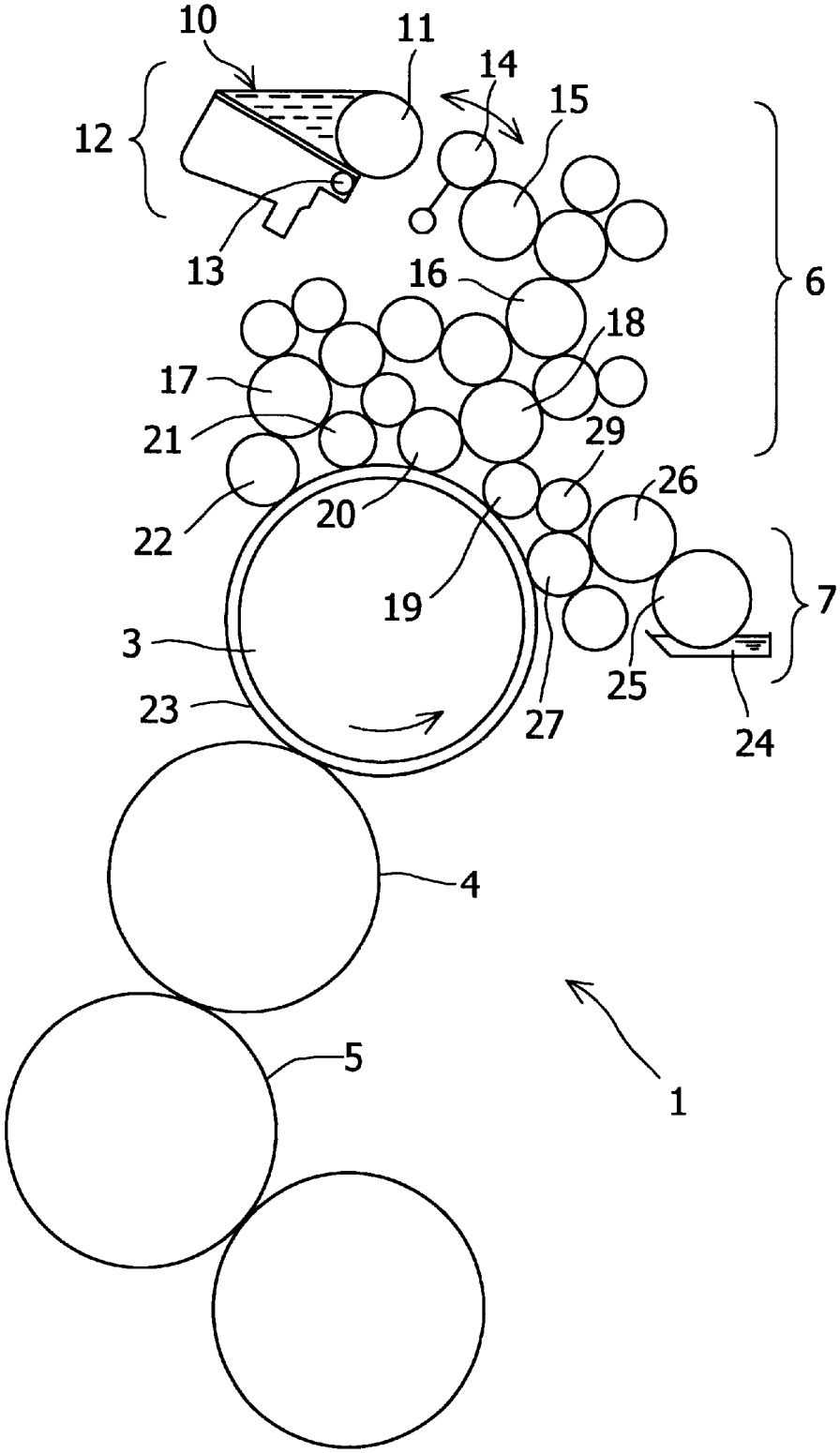
FIG. 1 is a schematic view showing a construction of a printing station for a sheet-fed offset press capable of using a method in accordance with the present invention.
Figure 2:
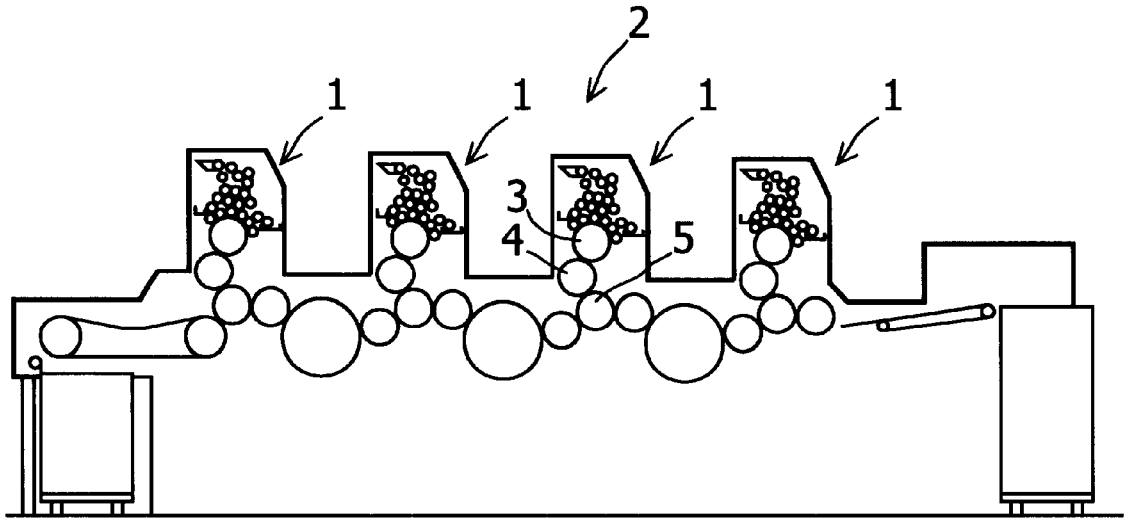
FIG. 2 is a schematic view showing a construction of a sheet-fed offset press capable of using a method in accordance with the present invention.

FIG. 1 shows an example of a printing station for a sheet-fed offset press to which a method for driving an oscillating roller in accordance with the present invention can be applied. The arrangement of a plurality of such printing stations can constitute a multi-color sheet-fed offset press as shown in FIG. 2.

Referring to FIG. 1, each of the printing stations 1 has a plate cylinder 3, a rubber blanket cylinder 4, and a back impression cylinder 5 as shown in the figure. Further, each of the printing stations 1 includes an ink supply system 6 and a dampening system 7. Such an offset press 1 is controlled by an electronic controller (not shown) equipped with a microprocessor. An operator can control the press through this electronic controller. The electronic controller controls the printing station 1; specifically, it controls not only the on/off operation of the plate cylinder 3, the rubber blanket cylinder 4, and the back impression cylinder 5, but also the ink supply system 6 and the dampening system 7.

In FIG. 1, printing ink is stored in an ink fountain 12 consisting of an ink tray 10 and an ink tray roller 11. A quantity regulating device 13, which is constituted of the arrangement of a plurality of regulating members each having a fixed width and lined up in the width direction of the press, is disposed so as to be in close contact with the ink tray roller 11, so that the quantity of supplied ink can be regulated by each width of the regulating member. An oscillating transfer roller 14 transfers printing ink from the ink tray roller 11 to a first oscillating roller 15. The ink is transferred with different ink layer thicknesses in the transverse direction with respect to the printing direction for each width of individual regulating member. The ink supply system further includes second, third, and fourth oscillating rollers 16, 17 and 18, a first form roller 19 for applying ink to a form plate 23 attached onto the surface of the plate cylinder 3, and other form rollers 20, 21 and 22. The dampening system 7 includes a dampening water fountain 24 on a tray, and a dampening roller 25 partially touches water in the fountain 24. A quantity regulating roller 26 is disposed in a state of touching the dampening water fountain 24. The dampening roller 25 and the quantity regulating roller 26 can be driven at varying speeds. Thereby, the feed quantity of dampening water can be changed, for example, so as to match the rotational speed of the roller group. The dampening water is transmitted to the form plate 23 and an intermediate roller 29 via a dampening roller 27 (which may also act as a form roller) that is in contact with the quantity regulating roller 26.

The aforementioned electronic controller carries out control of the whole printing machine during the operation of the printing machine including the start time and stop time, and keeps a proper quantity of dampening water. The ink supply system 6 and the form plate 23 are dampened. The electronic controller controls the positions of rollers, especially the touch and withdrawal of the oscillating rollers 15, 16, 17 and 18, and the distribution of dampening water in each step. When the printing operation is stopped, all of the rollers 19, 20, 21, 22 and 27 for applying ink and dampening water are withdrawn from the form plate 23. When the printing operation is restarted, the dampening roller 27 is brought into contact with the form plate 23 by the controller, by which dampening of the form plate 23 and the ink supply system 6 is executed via the intermediate roller 29. After this preliminary dampening, the oscillating rollers 15, 16, 17 and 18 are brought into contact with the form plate 23, by which ink film forming is performed. In the dampening and ink supplying operations, the oscillating rollers 15, 16, 17 and 18 perform a reciprocating straight motion in the axial direction to properly level the profile of ink supplied from an ink supply unit 12, by which uniform printing can be accomplished. In the method of the present invention, the driving of the oscillating rollers 15, 16, 17 and 18 is controlled in the optimum manner.

During the time when printing is performed by the offset press, a necessity for temporarily stopping the printing operation arises due, for example, to shifted positioning of paper sheets. After instructions to stop the printing operation are given, the controller issues instructions to withdraw the form rollers 19, 20, 21, 22 and 27 from the form plate 23. According to the present invention, at this time, the reciprocating straight motion in the axial direction (transverse oscillating motion) of the oscillating rollers 15, 16, 17 and 18 are first stopped, or the amplitude of this motion is reduced. Subsequently, after the plate cylinder 3 (form plate 23) has rotated several turns, preferably 2 to 7 turns and more preferably 3 to 5 turns, the form rollers 19, 20, 21, 22 and 27 (the form roller 27 also acts as a dampening roller) are actually withdrawn from the form plate 23. The reason for this is that by stopping the transverse oscillating motion before the stoppage of printing operation on an actual sheet, ink is to be supplied from the ink supply unit 12 to the roller group without being leveled in the axial direction of the rollers. Therefore, it is preferable to determine the time when the transverse oscillating motion of the oscillating rollers 15, 16, 17 and 18 is performed before the withdrawal of the form rollers, according to the distance on the rollers from the ink supply unit 12 to the form plate 23. Thereupon, when the printing operation is stopped, a profile of ink film thickness not leveled so much remains on the surfaces of rollers of the roller group, especially on the surfaces of the form rollers 19, 20, 21, 22 and 27. Thereby, the amount of spoilage caused by nonuniform printing at the time when the printing operation is restarted can be reduced.

Further, when the printing operation is started, the operator issues instructions to bring the form rollers 19, 20, 21, 22 and 27 into contact with the form plate 23. In response to this, the form rollers are brought into contact upon instructions from the controller. At this time, after the form rollers are brought into contact, the transverse oscillating motion of the oscillating rollers 15, 16, 17 and 18 is started after the plate cylinder 3 has been rotated several turns, preferably 2 to 7 turns and more preferably 3 to 5 turns. By delaying the start of transverse oscillating motion of the oscillating rollers 15, 16, 17 and 18 from the contact of the form rollers, the profile of film thickness of ink on the rollers leveled by the transfer between rollers performed during the stoppage of printing operation can be prevented from being uniformed unnecessarily by the transverse oscillating motion of the oscillating rollers 15, 16, 17 and 18. Therefore, a proper ink film thickness profile can be attained rapidly.

Figure 3:
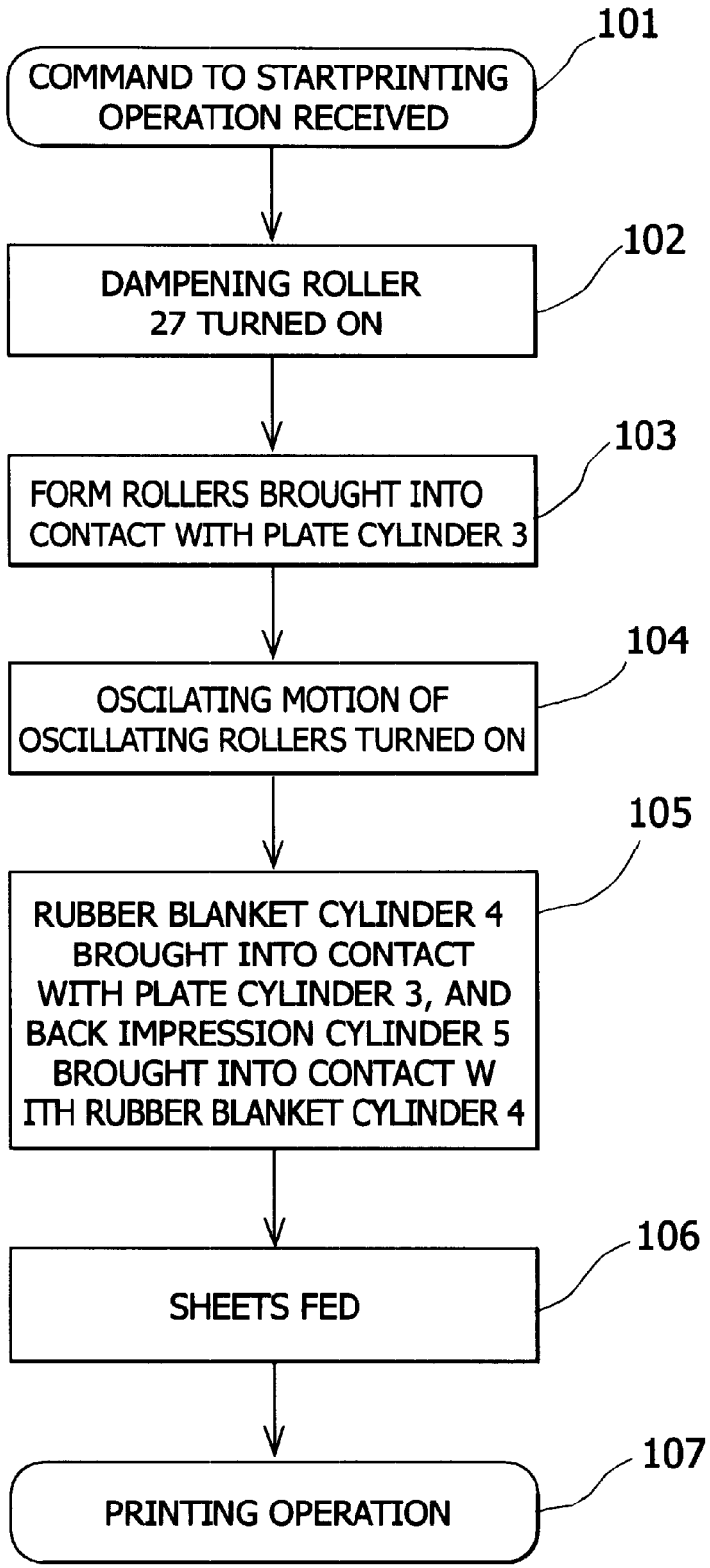
FIG. 3 is a flowchart showing a procedure for stopping operation in accordance with one embodiment of a method of the present invention.
Figure 4:
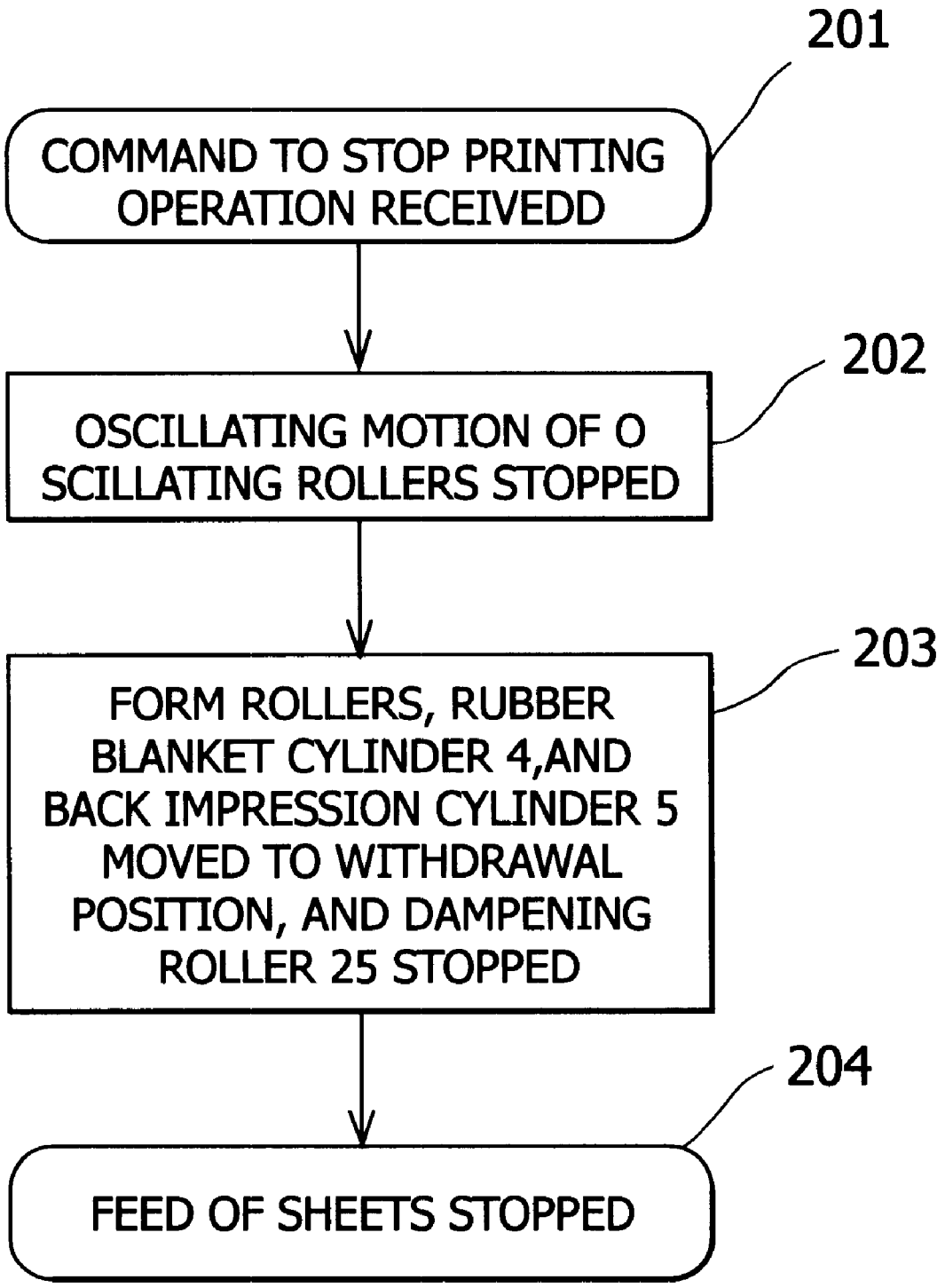
FIG. 4 is a flowchart showing a procedure for starting operation in accordance with one embodiment of a method of the present invention.

FIGS. 3 and 4 show an example of a flow of control procedure for a printing machine in accordance with the method of the present invention. Referring to FIG. 3, when a command to start the printing operation is received (101), the dampening roller 27 (also acts as a form roller) is turned on at fixed timing on the instructions of the controller (102). Then, after some delay, preferably after a delay of about 1 to 2 turns of the plate cylinder 3, the form rollers 19, 20, 21, 22 and 27 are brought into contact with the plate cylinder 3 (103). Subsequently, with a time interval of several turns of the plate cylinder 3, the transverse oscillating motion of the oscillating rollers 15, 16, 17 and 18 is turned on (104). At this time, the amplitude of the transverse oscillating motion may be increased immediately to the ordinary operation amplitude, or may be increased gradually to the ordinary amplitude. Also, the amplitude of the transverse oscillating motion can be increased from the state of complete stoppage or from the state of operation at a small amplitude to the ordinary amplitude. After that, at an interval of 1 to 3 turns of the plate cylinder 3, an operation of bringing the rubber blanket cylinder 4 into contact with the plate cylinder 3 and an operation of bringing the back impression cylinder 5 into contact with the rubber blanket cylinder 4 are performed substantially at the same time (105). Following these operations, the feed of sheets is started, and printing operation is actually started (106). Subsequently, a steady operation is performed (107).

As in an example shown in FIG. 4, when a command to stop the printing operation is received (201), the transverse oscillating motion of the oscillating rollers 15, 16, 17 and 18 is stopped or reduced upon instructions from the controller (202). Then, with a time interval of several turns of the plate cylinder 3, preferably at a time interval of 3 to 5 turns, the form rollers 19, 20, 21, 22 and 27, the rubber blanket cylinder 4, and the back impression cylinder 5 each are moved to the withdrawal position, by which the contacting state is released (203). At this time, the dampening roller 25 can also be stopped at the same time, or it can also be stopped after a delay of 1 to 3 turns of the plate cylinder 3. The feed of sheets can also be stopped at the same time (204).

Next, an embodiment of an oscillation mechanism for the oscillating rollers in the ink supply system for the printing press in accordance with the present invention will be described exemplarily in detail with reference to FIGS. 5 to 12. The dimensions, material, relative arrangement of components described in this embodiment do not limit the scope of the present invention, but represent only an explanatory example unless especially noted.

Figure 5:
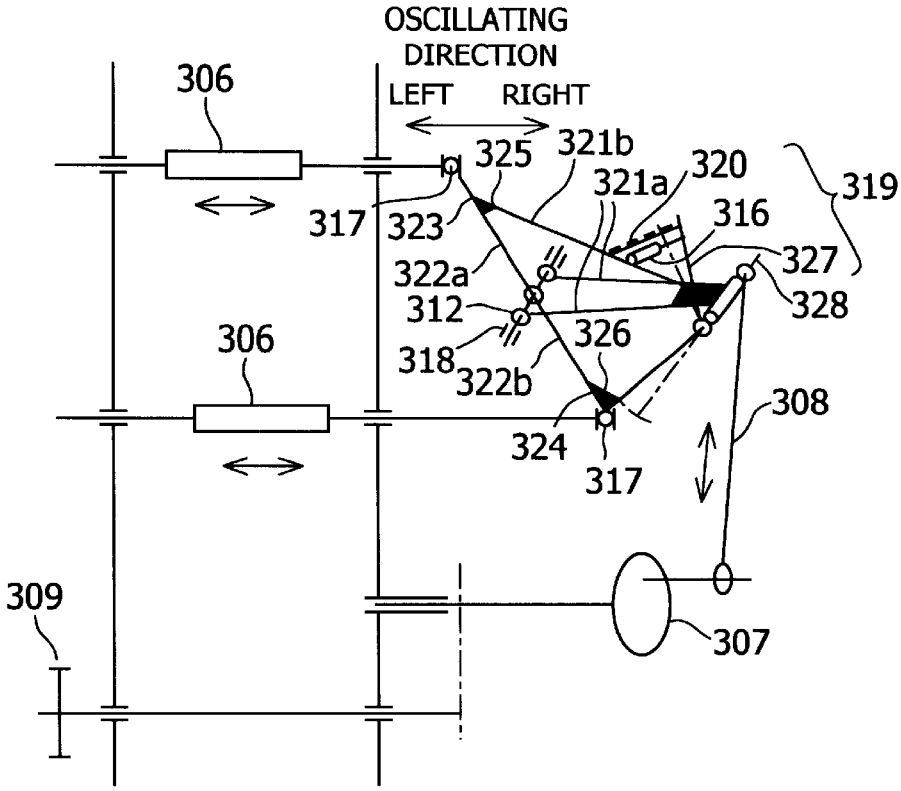
FIG. 5 is a schematic system diagram of oscillation drive for an oscillating roller in an ink supply system in accordance with the present invention.
Figure 6:
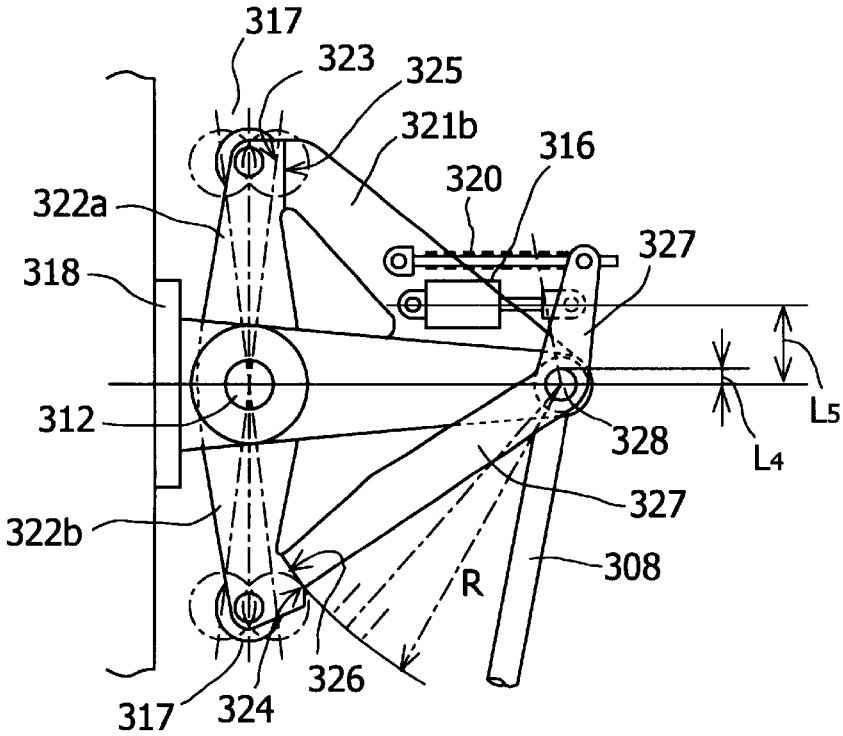
FIG. 6 is a configuration view of an embodiment of an oscillation mechanism and oscillation drive changeover mechanism for an oscillating roller in accordance with the present invention.

FIG. 5 is a system diagram of an oscillation drive for the oscillating roller in the ink supply system for the printing press in accordance with the present invention. FIG. 6 is a configuration view of the oscillation mechanism and oscillation drive changeover mechanism. In the figures, the same reference numerals are applied to the same elements as those of the previously mentioned related art.

Referring to FIGS. 5 and 6, an oscillation drive source 307 is rotated by a rotational force transmitted from a machine drive system 309, and a drive link 308 transmits an oscillating force via a crank or the like. Of two types of an oscillation drive lever 321 and an oscillating lever 322 that turn around a pin 312 supported on a bearer 318 fixed to a machine frame, the oscillating lever 322, consisting of balance-shaped oscillating levers 322*a* and 322*b* disposed at about 180 degrees with respect to the pin 312, is provided with an oscillation transmitting portion 317 at each end to oscillate an oscillating roller 306.

The oscillating lever 322*a*, 322*b* has an oscillation drive bearing portion 323, 324, respectively, so as to receive an oscillating force from an oscillation drive transmitting portion 325 of an oscillation drive lever 321*b* and an oscillation drive transmitting portion 326 of a changeover member 327, which are in face-to-face contact with the oscillation drive bearing portion 323, 324. At the other end of the oscillation drive lever 321 is provided an oscillation drive pin 328 to receive an oscillating force from the drive link 308. The oscillation drive lever 321, which is oscillated around the pin 312 by receiving an oscillating force from the drive link 308, has a projecting arm 321*b*. The distal end of the arm 312*b* is in face-to-face contact with the oscillation drive bearing portion 323 of the oscillating lever 322*a* so as to transmit a force in one direction (a force in the left direction in FIG. 5) of the oscillating force.

Also, the changeover member 327, which turns around the oscillation drive pin 328, is provided with the oscillation drive transmitting portion 326 at one end. The oscillation drive transmitting portion 326 comes into contact with and separates from the oscillation drive bearing portion 324 of the mating oscillating lever 322*b* so as to transmit a force in the other direction (a force in the right direction in FIG. 5) transmitted to the oscillation drive pin 328. The changeover member 327 is turned around the oscillation drive pin 328 by the action of a changeover actuator 316. One end of the changeover actuator 316 is supported on the oscillation drive lever 321, and the other end thereof is engaged with the changeover member 327. The changeover actuator 316 may be driven in both directions, or may be driven only in one direction and the changeover member 327 may be moved in the other direction by using a spring 320 shown in FIG. 6.

The oscillation drive transmitting portion 326 provided at one end of the changeover member 327 is formed with an arcuate face having a radius R with the oscillation drive pin 328, which is the turning center, being the center or a face approximate to the arcuate face at the distal end thereof. The face of the oscillation drive bearing portion 324 of the oscillating lever 322*b*, which is the mating face of the oscillation drive transmitting portion 326, has a shape such as to be in face-to-face contact with the face of the oscillation drive transmitting portion 326 of the changeover member 327.

Next, the operation of the oscillation mechanism will be described with reference to FIG. 6. In the case where the oscillation drive transmitting portion 326 of the changeover member 327 is in contact with the oscillation drive bearing portion 324 of the oscillating lever 322*b* as shown in FIG. 6, when the drive link 308 moves downward in the figure, the oscillation drive lever 321 and the changeover member 327 move together in the downward direction, by which the oscillation drive bearing portion 324 of the oscillating lever 322 is pressed. Therefore, the oscillating lever 322*b* moves to the left in the figure with the pin 312 being the center, the not illustrated oscillating roller 306 oscillates to the left, and the oscillating roller 306 connected to the oscillating lever 322*a* at the other end moves to the right.

When the drive link 308 moves inversely in the upward direction in the figure, the oscillation drive transmitting portion 325 of the oscillation drive lever 321*b* presses the oscillation drive bearing portion 323 of the oscillating lever 322*a*. Therefore, the oscillating lever 322*a* moves to the left in the figure with the pin 312 being the center, the not illustrated oscillating roller 306 oscillates to the left, and the oscillating roller 306 connected to the oscillating lever 322*b* at the other end moves to the right. A similar operation is repeated by the up-and-down movement of the drive link 308, so that the oscillating rollers 306 are oscillated from side to side.

At this time, when a command to stop the oscillation of the oscillating rollers is given by the not illustrated controller, the command is transferred to the actuator 316 to operate the actuator 316, so that the changeover member 327 is pulled to the side of the actuator 316, and therefore the oscillation drive transmitting portion 326 comes off from the oscillation drive bearing portion 324 of the oscillating lever 322*b*. Therefore, even if the drive link 308 moves downward in the figure, although the oscillation drive lever 321 moves downward, there is nothing that presses the oscillation drive bearing portion 324 of the oscillating lever 322, so that the oscillating lever 322*b* does not move.

When the drive link 308 moves inversely in the upward direction in the figure, the oscillation drive transmitting portion 325 of the oscillation drive lever 321*b* presses the oscillation drive bearing portion 323 of the oscillating lever 322*a*. Therefore, although the oscillating lever 322*a* moves to the left in the figure with the pin 312 being the center, there is nothing that presses the oscillation drive bearing portion 324 of the oscillating lever 322, as described above, so that the oscillating lever 322 does not return in the reverse direction. Thereupon, the oscillation of the oscillating rollers 306 stop at this time.

The above is a description of the operation of the oscillation mechanism for the oscillating rollers in accordance with the present invention. As can be seen from the above description, the oscillating force transmitting portions, that is, the oscillation drive transmitting portion 325, 326 and the oscillation drive bearing portion 323, 324 are in face-to-face contact with each other, so that less wear occurs in the transmitting portion. Therefore, there is no influence such as an impact force caused by an increased gap. For this reason, the oscillation mechanism in accordance with the present invention can be used steadily for a long period of time without less maintenance, and the cost for remedying wear is low. Also, the vibrations of the printing press caused by the impact force are small, so that high printing quality can be obtained.

Also, as shown in FIG. 6, since the distance L5 to the point of application of the changeover actuator 316 is far larger than the distance L4 to the resistance force occurrence potion, the output of the actuator 316 can be made low, and therefore the shape thereof can be made small. Therefore, the efficiency of utilization of tight space is enhanced, so that the size of the whole mechanism can be made small.

Figure 7:
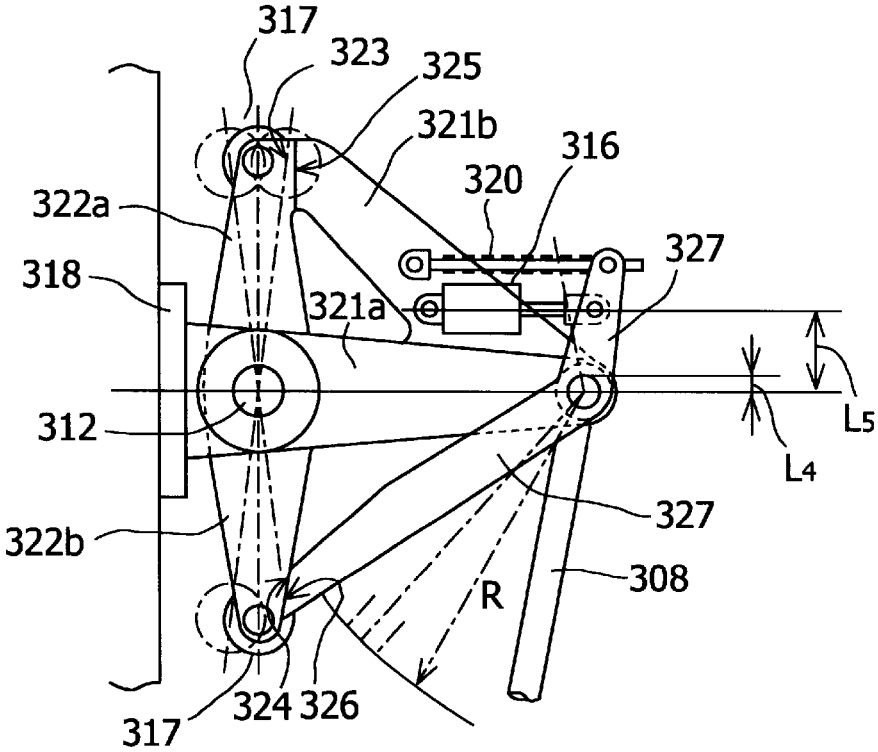
FIG. 7 is another embodiment of an oscillation mechanism in accordance with the present invention.

Although the shape of the oscillation drive lever 321*b* is made an arm shape in the above description, the shape thereof is not limited to this. For example, as shown in FIG. 7, the shape thereof may be made a triangular shape, and the oscillation drive transmitting portion 325 and the oscillation drive bearing portion 323 may be wider. Also, although the oscillation drive transmitting portion 326 of the changeover member 327 and the oscillation drive bearing portion 324 are substantially at right angles to the lengthwise direction of the changeover member 327 as shown in FIG. 6 in the above description, they may have a shape that coincides with the outside shape of the oscillating lever 322*b* as shown in FIG. 7. In this case, when the changeover member 327 returns to the original position on instructions to restart oscillation after the changeover member 327 is separated from the oscillating lever 322*b* on instructions to stop oscillation drive, even if the oscillating lever 322*b* lies at any position, the changeover member 327 can return easily. Also, although the oscillation drive transmitting portion 325, 326 and the oscillation drive bearing portion 323, 324 are face-to-face contact with each other in the above description, one of the two may be of a roller type.

Figure 8:
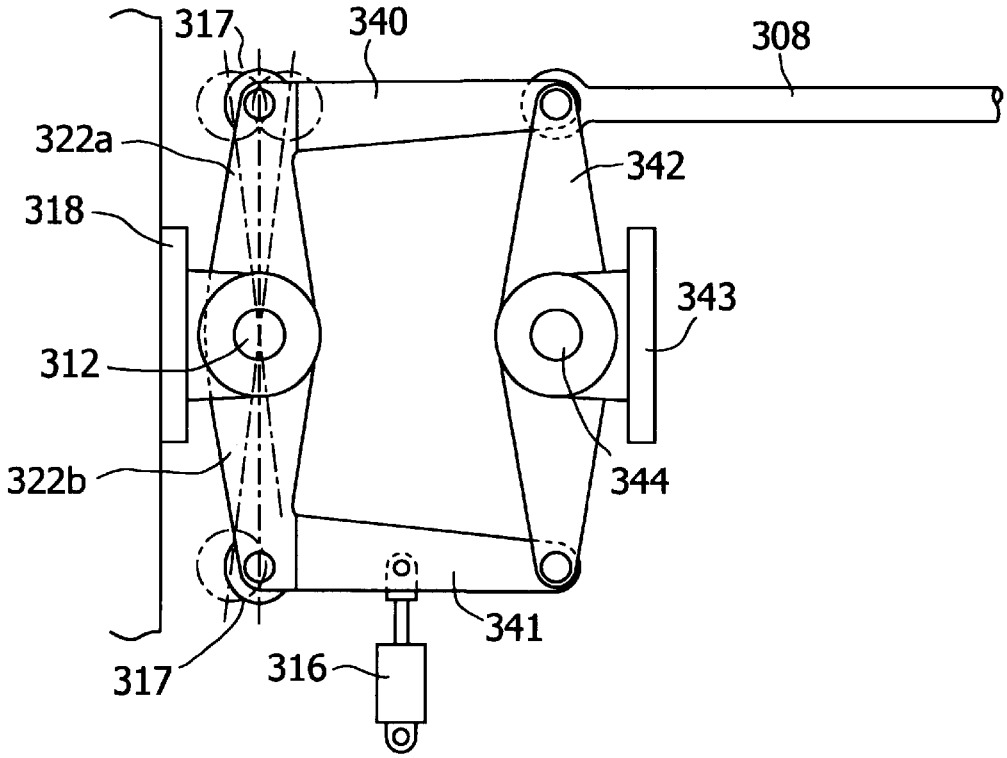
FIG. 8 is still another embodiment of an oscillation mechanism in accordance with the present invention.
Figure 9:
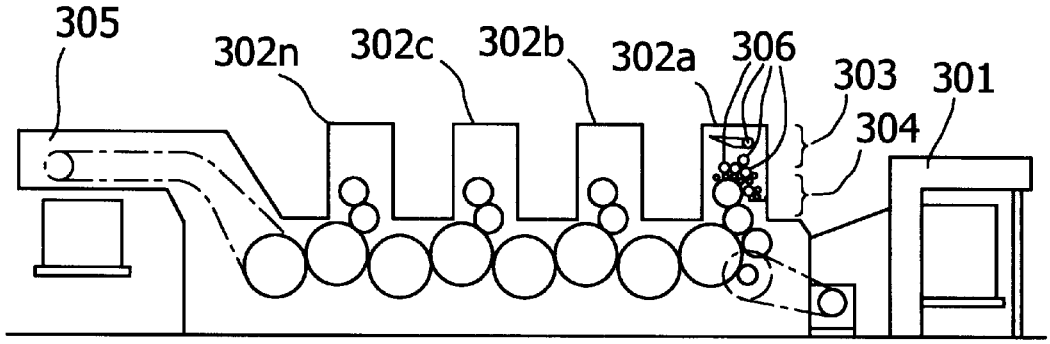
FIG. 9 is a schematic view showing the outline of a general printing press.
Figure 10:
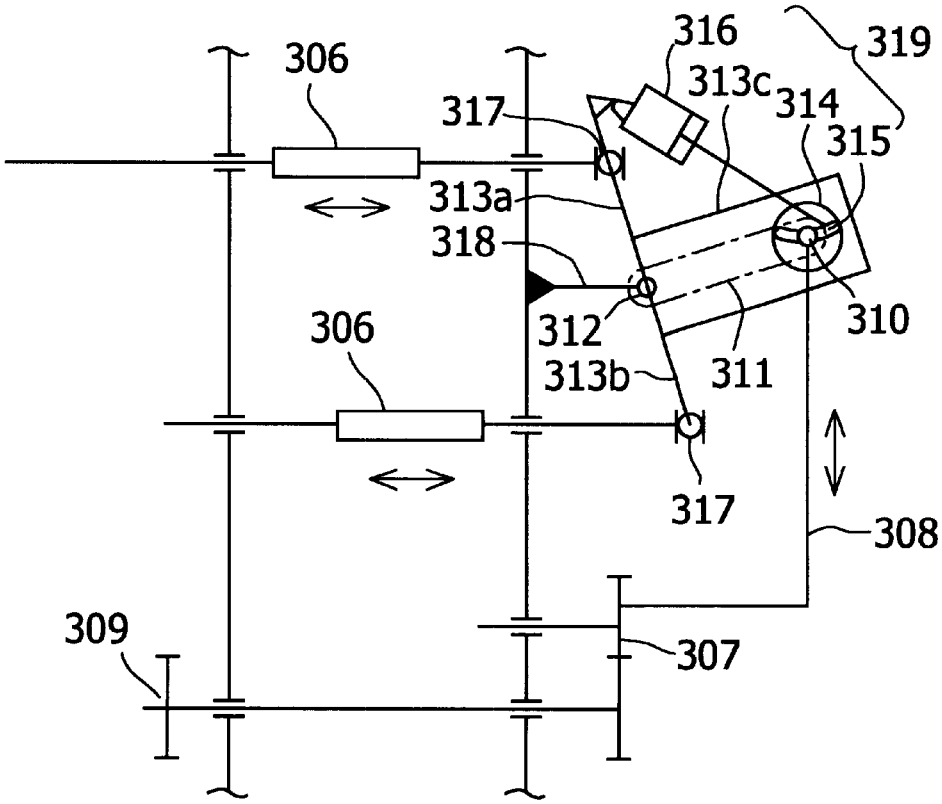
FIG. 10 is a system diagram of an oscillation drive.
Figure 11:
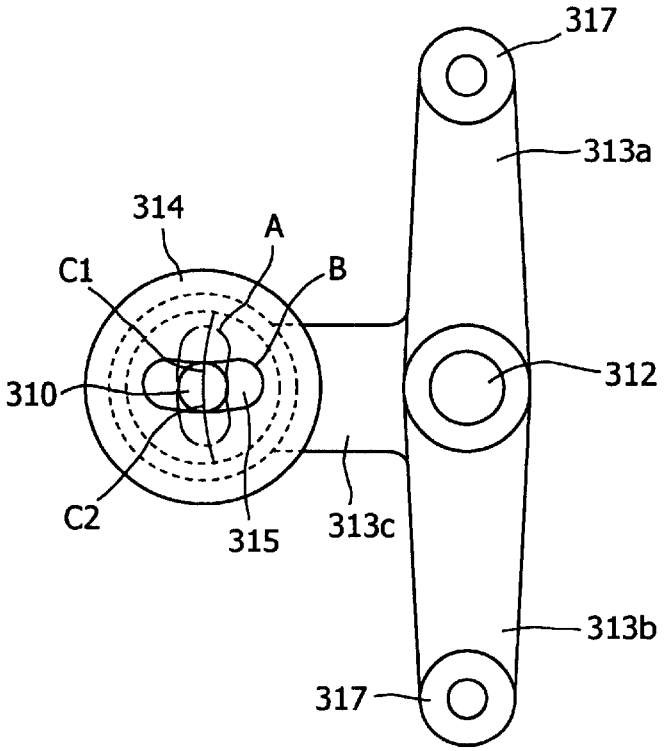
FIG.11 (RELATED ART)
FIG. 11 is a view showing an essential part of a mechanism for starting and stopping an oscillating roller relating to the present invention.
Figure 12:
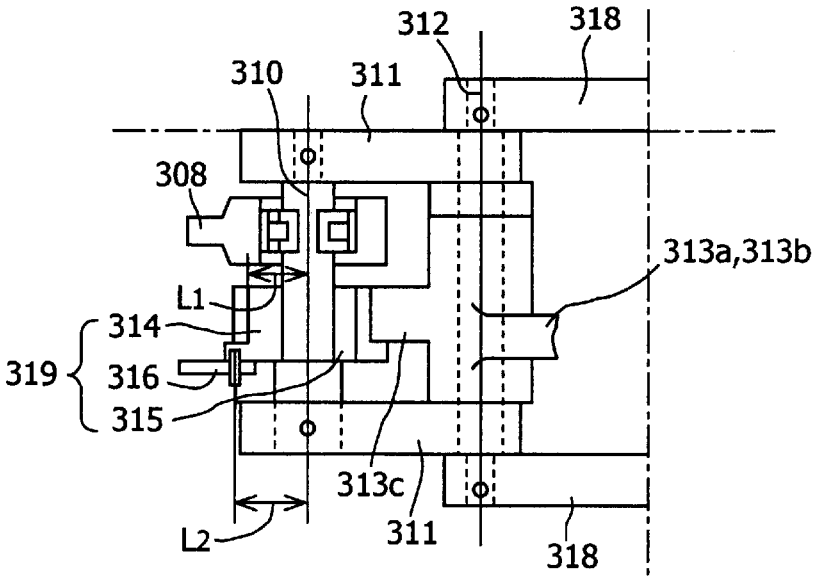
FIG.12 (RELATED ART)
FIG. 12 is a sectional view of FIG. 11.

Also, the mechanism itself composed of the oscillation drive lever 321 and the changeover member 327 is not limited to the mechanism shown in FIG. 6, and it may have a parallelogram shape as shown in FIG. 8. In FIG. 8, reference numeral 340 denotes the oscillation drive lever, and 341 denotes the changeover member. The oscillation drive lever 340 and the changeover member 341 are configured so that the oscillation drive lever 340 is fixed to one end of an arm 342 pivotally supported by a pin 344 of the bearer 343, and the changeover member 341 engages with the actuator 316 and is pivotally supported by one end of the arm 342.

The drive link 308, which is pivotally supported by one end of the arm 342, transmits an oscillation drive force. In the state shown in FIG. 8, the oscillation drive lever 340 and the changeover member 341 are in contact with the oscillating lever 322, so that when the drive link 308 reciprocates transversely in the figure, the arm 342 and the oscillating lever 322 move in exactly the same manner. Accordingly, the oscillating rollers 306 connected to the oscillating lever 322 also move in exactly the same manner.

As in the case of the above description, when instructions to stop oscillation are given, the actuator 316 is operated, so that the changeover member 341 comes off from the oscillating lever 322. As a result, the movement of the drive link 308 is not transmitted to the oscillating lever 322. It is to be noted that the drive link 308 may be pivotally supported on the changeover member side of the arm 342, not at the position shown in FIG. 8.

In the case of the embodiment shown in FIG. 8, the contact point of the oscillating lever 322 and the oscillation drive lever 340 is shifted by oscillation. To accommodate this shift, for example, the configuration may be such that the oscillation drive lever 340 is pivotally supported coaxially with the drive link 308, and a guide member for holding the oscillation drive lever 340 is fixed to the arm 342, by which the oscillation drive lever 340 is prevented from coming off from the contact point of the oscillating lever 322. Also, inversely, the drive link 308 may be extended to be used as an energizing member for the oscillating lever 322. In this case, the drive link 308 and the arm 342 may be pivotally fixed to each other with a play provided between them.

What is claimed is:

1. A method for operating a sheet-fed offset press in which an oscillating roller accomplishes an oscillating motion, comprising the steps of:

receiving a command to stop printing operation;

stopping the oscillating motion of said oscillating roller; and subsequently separating a form roller from a form plate after a plate cylinder rotates 2 to 7 turns.

2. A method for operating a sheet-fed offset press in which an oscillating roller accomplishes an oscillating motion, comprising the steps of:

receiving a command to start printing operation;

bringing a form roller into contact with a form plate placed on a plate cylinder; and subsequently starting the oscillating motion of said oscillating roller after said plate cylinder rotates 2 to 7 turns.

3. A sheet-fed offset press on which the operating method according to claim 1 is carried out.

4. A sheet-fed offset press on which the operating method according to claim 2 is carried out.

* * * * *